United States Patent [19]

Collins

[11] Patent Number: 4,920,906

[45] Date of Patent: May 1, 1990

[54] KEEL STRUCTURES FOR SAILING VESSELS

[76] Inventor: Warwick I. Collins, 23 Kingston Park, Lymington, Hampshire, England

[21] Appl. No.: 277,493

[22] Filed: Nov. 29, 1988

Related U.S. Application Data

[63] Continuation of Ser. No. 726,892, filed as PCT GB84/00291 on Aug. 21, 1984, published as WO85/01027 on Mar. 14, 1985, abandoned.

[30] Foreign Application Priority Data

Aug. 23, 1983 [GB] United Kingdom ..... 8322576
Sep. 2, 1983 [GB] United Kingdom ..... 8323616

[51] Int. Cl.[5] ..... B63B 3/38; B63H 25/38
[52] U.S. Cl. ..... 114/140; 114/39.1
[58] Field of Search ..... 114/39.1, 127, 1, 133, 114/140, 141, 149, 162

[56] References Cited

U.S. PATENT DOCUMENTS 537,667 4/1895 Beardsley et al. ..... 114/132

FOREIGN PATENT DOCUMENTS 2010953 9/1971 Fed. Rep. of Germany .
1577290 8/1969 France ..... 114/127
11609 6/1894 United Kingdom ..... 114/140

*Primary Examiner*—Joseph F. Peters, Jr.
*Assistant Examiner*—Edwin L. Swinehart
*Attorney, Agent, or Firm*—Renner, Otto, Boisselle & Sklar

[57] ABSTRACT

A tandem keel structure (12) for a sailing vessel such as a yacht (10) comprises a main keel (14). A bridge (16) extends forwardly from the foot of the main keel (14) and a forward foil (18) is attached between the forward end of the bridge (16) and the hull of the yacht. The forward foil (18) is separated from the main keel or foil (14) by a slot (20).

18 Claims, 4 Drawing Sheets

KEEL STRUCTURES FOR SAILING VESSELS

This is a continuation of co-pending application Ser. No. 726,892 filed as PCT GB84/00291 on Aug. 21, 1984, published as WO85/01027 on Mar. 14, 1985, now abandoned.

This invention relates to keel structures for sailing vessels, for example sailing yachts.

According to the present invention there is provided a keel structure for a sailing vessel, the keel structure comprising a main keel having a bridge extending forwardly from its foot and a forward foil or keel which is mounted between the underneath of the vessel and the forward end of the bridge so as to be disposed forwardly of and in tandem with the main keel.

A keel structure in accordance with the present invention, in which a forward foil is disposed forwardly of the main keel, provides weed deflection, which in turn allows increased flexibility as regards the shape of the main keel, which can enable improvement in the hydrodynamic efficiency and/or righting moment of the main keel.

The invention will now be further described, by way of illustrative and non-limiting example, with reference to the accompanying drawings, in which like references indicate like items throughout and in which shaded areas indicate trimmable sections or surfaces which can be adjusted while sailing. In the drawings.

Figure 1:
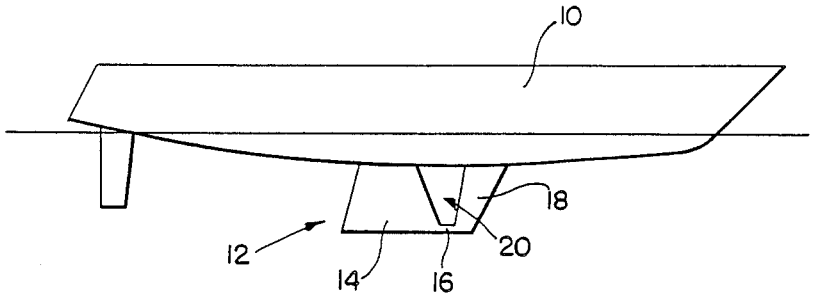
FIG. 1 is a side view of a sailing yacht fitted with a tandem keel structure embodying the invention.

FIG. 1 shows a sailing yacht 10 fitted with a tandem keel structure 12 comprising a non-movable main or rear keel or hydrodynamic foil 14 having a bridge 16 extending forwardly from its foot, and a second keel or hydrodynamic foil 18 which is fitted between the underneath of the hull of the yacht 10 and the forward end of the bridge 16 so as to be disposed forwardly of and in tandem with the main foil 14 with a slot 20 being defined between the foils. Preferably, but not essentially, the second or forward foil 18 is smaller than the non-movable main foil 14, such forward foil 18 preferably having an average chord length which is less than the average chord length of the non-movable section of the main foil 14 as illustrated in the drawings. Also, the slot 20 is generally V-shape, such slot having a longer chord length at the root (top) than at the tip (bottom), such longer chord length as well as the average chord length of the slot 20 being less than the average chord length of the non-movable section of the main foil 14 as shown.

Figure 2:
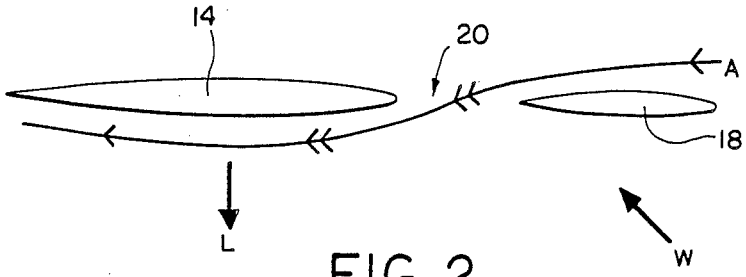
FIG. 2 is a diagrammatic view from above illustrating a slot effect that can take place between forward and main foils or keels of the keel structure, whereby the flow between the foils is accelerated.

When the tandem keel structure 12 is under load (for example, while the yacht 10 sails to windward), a beneficial slot effect develops in the slot 20 between the foils, 14, 18 such that a flow of water is accelerated through the slot 20 and over the windward side of the rear foil 14, improving the 'lift' of the rear foil 14, i.e. a force tending to move the foil 14 to windward. More specifically, as shown in FIG. 2, in which an arrow W indicates the wind direction, a water flow denoted by an arrow A is subjected to acceleration through the slot 20 as the water passes from the high pressure side of the forward foil 18 to the low pressure side of the rear foil 14, thereby accelerating flow over the windward side of the rear foil (main keel) 14 and thus in turn increasing the lift (represented by an arrow L) generated by the keel 14 to windward, thereby counteracting leeway and providing a reduction in the overall drag caused by the hull in motion.

The illustrated forward foil and rear or main foil configuration is highly resistant to stall, in a manner which it is believed may be somewhat analogous to the stall resistance exhibited by closely coupled canard-/main wing configurations to be found in several types of modern combat aircraft. At or near stall, the forward foil 18 ensures flow over the low-pressure side of the main or rear foil 14. The resulting stall-resistance is important during tacking manoeuvres, in particular immediately after the tack, when way has fallen off, the leeway angle is increased, and the flow may thus become partially or wholly detached from the foil. The improved resistance to stall of such a tandem configuration thus tends to improve acceleration after the tack, which is an important potential advantage in competitive racing.

The forward foil 18, which has a swept back leading edge and projects forwardly of the forward end of the bridge 16, permits considerable variation in shape of the rear foil 14, while the tandem keel structure 12 as a whole maintains useful weed-deflecting properties. Structurally, a wide variation in the sweep angle of the leading edge of the rear foil 14 becomes possible, as does a greater degree of inverse taper for any given sweep-back angle of the trailing edge of the rear foil 14. (Recent research on 12-meter keels has indicated the possible benefits of inverse taper in shifting the centre of effort of the keel away from the free air-water surface, and in permitting also a lower centre of gravity for a given weight of keel).

The main or rear foil 14 may incorporate such various features as reduced backsweep on the leading edge, a near vertical or vertical leading edge, a forward swept or strongly forward swept leading edge, and may be so shaped as to incorporate reduced taper, no taper, inverse taper, or substantial inverse taper. This freedom to select the required shape of the main keel or foil 14 can enable improvement in its hydrodynamic efficiency and/or righting moment. For example, the righting moment may be increased by so shaping the keel 14 that its centre of gravity is lowered.

The forward foil 18 may also be of a variety of shapes.

Figure 3:
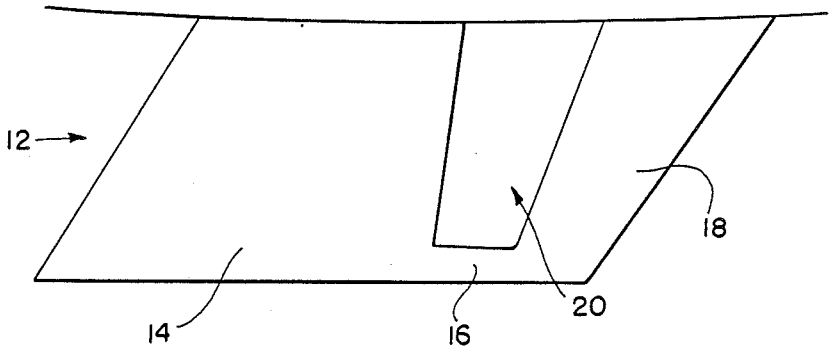
FIG. 3 is an enlarged side view of a tandem keel structure embodying the invention in which the main foil does not possess sufficient sweepback at the leading edge to deflect weed effectively, such deflection being supplied in part by the forward foil.
Figure 4:
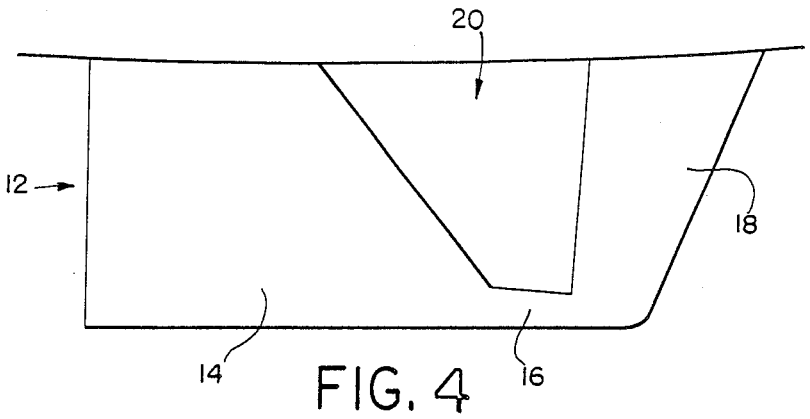
FIG. 4 is an enlarged side view of a tandem keel structure embodying the invention in which a strong degree of forward sweep is incorporated in the leading edge of the main foil, weed deflection being provided by the forward foil.

FIG. 3 shows, by way of example, a tandem keel structure in which the leading edge of the rear or main foil or keel 14 is near vertical and therefore does not posess sufficient sweepback at the leading edge to deflect weed effectively. However, such a configuration can be used since weed deflection is provided by the forward foil or keel 18. Further, FIG. 4 shows a structure in which the leading edge of the main foil or keel 14 is strongly swept forward. In a conventional keel structure, a strong degree of sweepforward at the leading edge (say more than 15°) is undesirable, because the keel tends to gather weed, detritus lobster pots and so forth, which can reduce performance, and can even be dangerous in the event, for example, of fouling a mooring rope or chain. The deflection action of the forward foil 18, whose leading edge is swept back, enables the use of a swept forward main foil 14 (which can be advantageous as regards improved hydrodynamic efficiency and stall-resistance) with relative safety.

Figure 5:
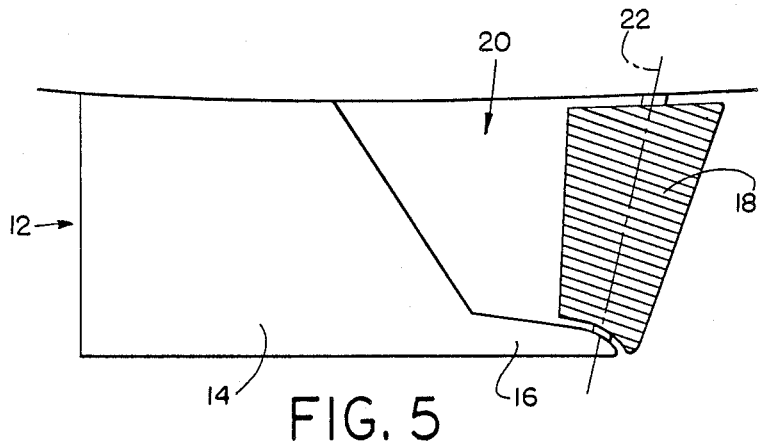
FIG. 5 is an enlarged side view of a tandem keel structure embodying the invention in which the forward foil is articulated at upper and lower joints thereof to provide a trimmable surface capable of varying the flow over the main foil.
Figure 6:
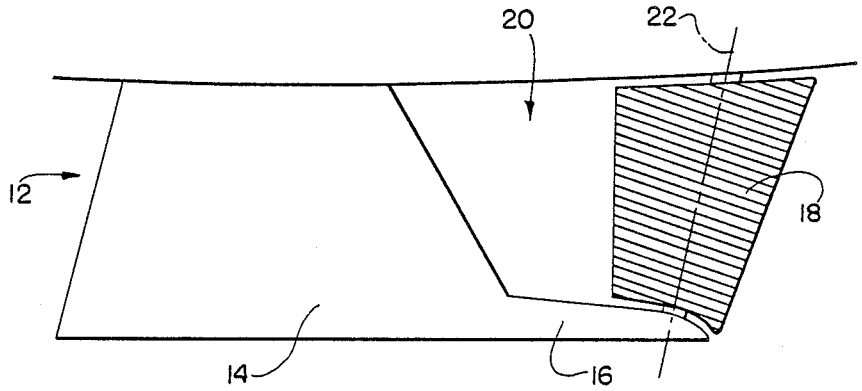
FIG. 6 is an enlarged side view of a tandem keel structure embodying the invention having a trimmable forward foil which is sufficiently powerful to act as a rudder, obviating the need for a separate stern rudder.

FIG. 5 shows a keel structure 12 in which the forward foil 18 is movable or trimmable about an axis 22 extending between the underside of the vessel and the bridge by means of joints at its upper and lower connection points to the hull and bridge 16, respectively, which permits varying control both of the 'slot effect' between the forward and rear foils 14, 18 and flow over the rear foil 14. If sufficiently powerful, by virtue of size or placement or both, e.g. if positioned forward of the centre of effort, such a forward foil 18 also has potential steering properties which may in turn obviate the need for the yacht 10 to have a rear or stern rudder: see FIG. 6.

Figure 7:
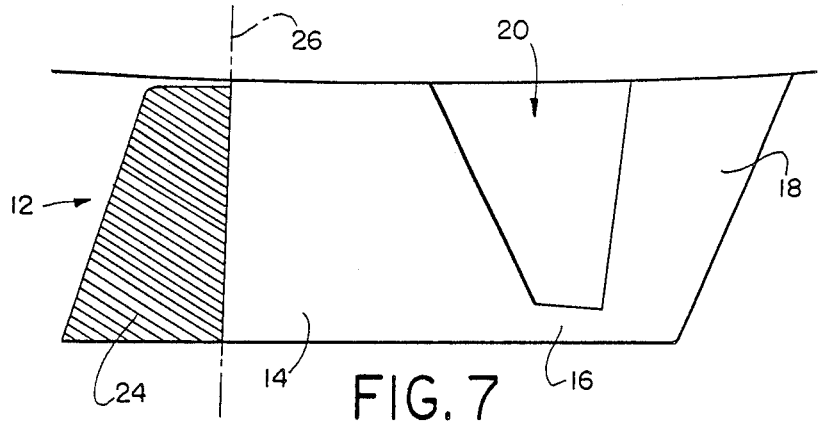
FIG. 7 is an enlarged side view of a tandem keel structure embodying the invention in which a trim tab has been incorporated in the aft section of the main foil.

The improved attachment of flow to the low-pressure side of the rear or main foil 14 also enhances flow attachment to surfaces of a trimmable or movable member 24 (trim tab or rudder) which may be incorporated in the rear section of the main foil 14 so as to be movable about an articulation joint defining an axis 26 at the forward end of the movable member 24 extending generally perpendicular to the underside of the vessel: see FIG. 7. Improved flow attachment on such surfaces upgrades their efficiency with respect to windward lift or boat direction control for a given drag penalty. If the member 24 is sufficiently powerful (see FIG. 8), by virtue of a size or placement or both, it may be used in place of a rear or stern rudder.

Figure 8:
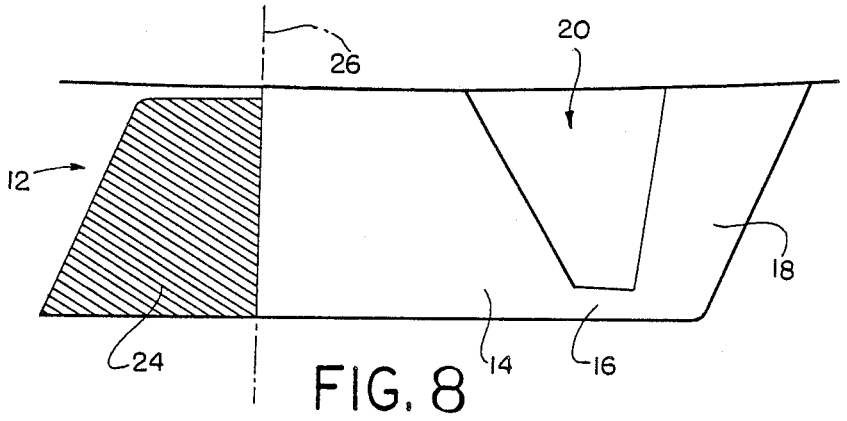
FIG. 8 is an enlarged side view of a tandem keel structure embodying the invention in which a trimmable section on the rear foil is sufficiently powerful to act as a rudder, obviating the need for a separate stern rudder.
Figure 9:
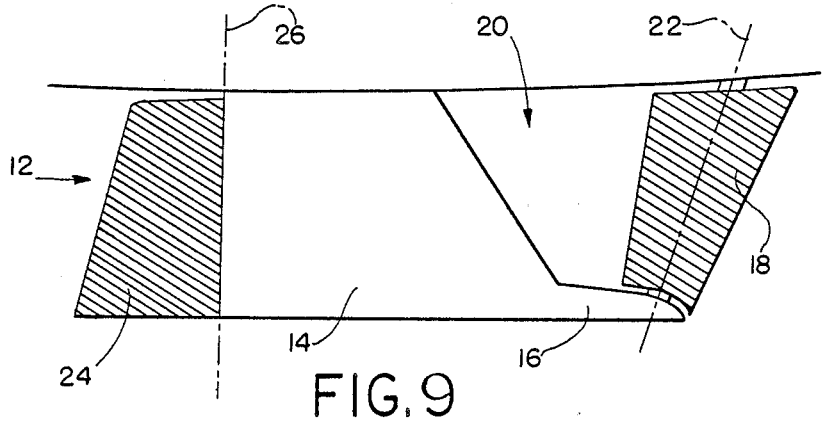
FIG. 9 is an enlarged side view of a tandem keel structure embodying the invention in which both the forward foil and the aftermost section of the rear foil are trimmable.

FIG. 9 shows a tandem keel structure incorporating both a trimmable forward foil 18 (as in FIGS. 5 and 6) and a trimmable member 24 at the rear of the main foil 14 (as in FIGS. 7 and 8). The interaction between the forward trimmable foil 18 and the rear trimmable section 24 of the main foil 14 is complex, but must be based in large part on the observation that, as the deflection of the rear trim tab or section 24 increases, so the upwash generated by the main foil increases 14, and thus in turn the angle of attack of the forward foil 18 (which inhabits the area of upwash caused by the main foil) is increased. Trimming of the forward foil 18 under such circumstances would consist of experimenting with trim angles for given settings of the rear trim tab 24 in order to discover optimum lift-drag ratios.

The overall advantage of such configurations is that by trimming the movable sections to form a lifting shape which is more efficient than a non-movable keel, the size and wetted area of the keel as a whole can be reduced, in turn reducing the overall drag relative to a fixed keel.

Figure 10:
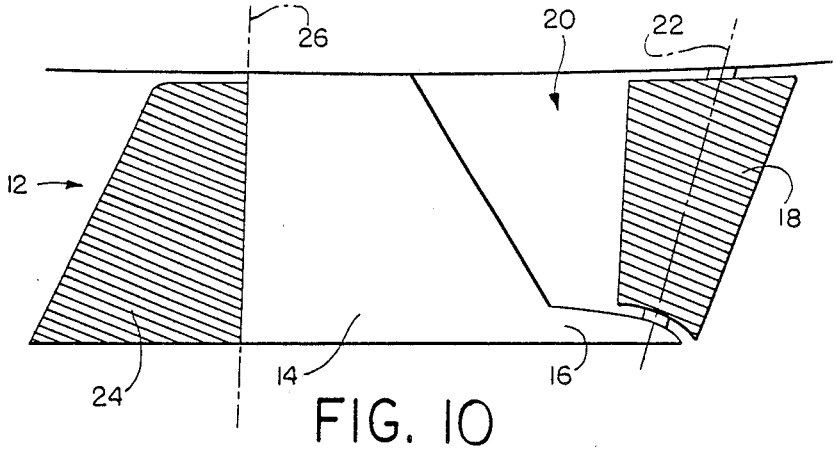
FIG. 10 is an enlarged side view of a tandem keel structure embodying the invention in which both a trimmable forward foil and an aftermost rear foil section can be used, independently or in conjunction, to steer the boat, obviating the need for a separate stern rudder.
Figure 11:
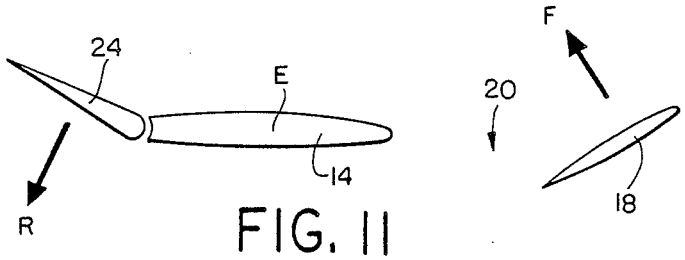
FIG. 11 is a diagramatic view from above of a tandem keel as illustrated in FIG. 10, with control surfaces shown deflected to steer the boat to port.

Forward and rear control surfaces constituted by the trimmable forward foil 18 and the member 24 can be used in conjunction to steer the boat: see FIG. 10. FIG. 11 is a view from above of the keel structure of FIG. 10 which shows how the boat may be steered by trimming the forward foil 18 and the rear section 24 of the main foil 14 to produce a rotating moment about a centre of effort E located in the fixed section 14. Force produced by the forward foil 18 is denoted by an arrow F, and force produced by the rear section 24 of the main foil 14 is denoted by an arrow R. FIG. 11 shows the two control surfaces deflected to turn the boat to port. To turn to starboard, the respective deflections are reversed.

Figure 12:
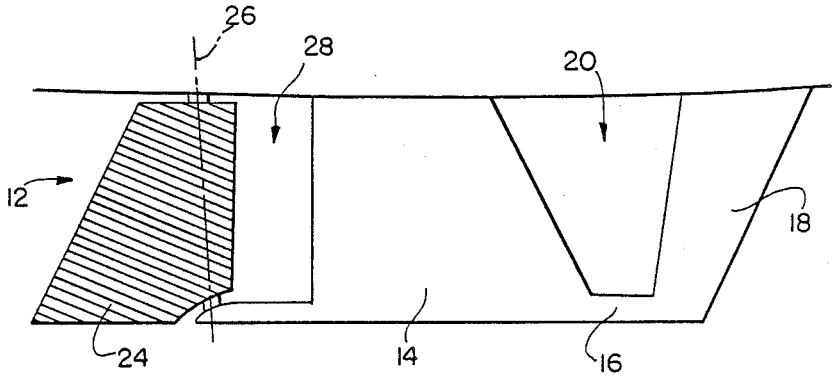
FIG. 12 is an enlarged side view of a tandem keel structure embodying the invention in which a rear trim tab or rudder is joined at the base to, but separated by a slot from, the main foil.

FIG. 12 shows another form of the tandem keel structure 12 in which an additional separation or slot 28 is formed between a rear trimmable foil 24 and the main fixed foil 14.

The invention can of course be implemented in other ways than those described above by way of example. For instance, any tandem keel structure as disclosed above, which incorporates in the base of one or both foils a bulb, endplate or hydrodynamic winglets, will, because of the tandem foil configuration of its vertical surfaces, fall within the scope of the claims.

Furthermore, any keel which, in addition to the tandem foil configuration as outlined above, incorporates a further foil or foils in such a manner as that all foils, whether fixed or movable, are joined at the base by a bridge, also will fall within the scope of the claims.

I claim:

1. A keel structure for a sailing vessel, said keel structure comprising a fixed main keel including a non-movable section having a foot and a bridge extending forwardly from said foot, said bridge having a forward end, and a forward foil adapted to be mounted between the underside of the vessel and said forward end of said bridge, said main keel and said forward foil when in use of said keel structure having a high pressure side and a low pressure side, said non-movable section of said main keel having an average chord length, said forward foil being disposed forwardly of and in tandem with said main keel an average distance less than the average chord length of said non-movable section of said main keel to provide a relatively close coupling of said forward foil to said main keel to define with said main keel slot means which during use of said keel structure causes water to be accelerated through said slot means from the high pressure side of said forward foil to the low pressure side of said main keel to increase the lift acting on said main keel, said forward foil being smaller than said non-movable section of said main keel.

2. The keel structure of claim 1 wherein said forward foil has a leading edge that is swept rearward, and said main keel has a leading edge which is closest to said forward foil that is swept forward.

3. The keel structure of claim 1 wherein said main keel has a rear section that is movable relative to said non-movable section by means of an articulation joint between said rear section and said non-movable section.

4. The keel structure of claim 3 wherein said articulation joint has an axis generally perpendicular to the underside of the vessel.

5. The keel structure of claim 3 wherein said rear section of said main keel is sufficiently powerful to act as a rudder, obviating any need for the vessel to have a separate stern rudder.

6. The keel structure of claim 1 wherein said slot means is generally V-shape having a longer chord length at the top than at the bottom, said longer chord length of said slot means being less than the average chord length of said non-movable section of said main keel.

7. The keel structure of claim 1 further comprising at least one further foil joined to the base of said main keel.

8. The keel structure of claim 7 wherein said further foil is fixed.

9. The keel structure of claim 7 wherein said further foil is movable.

10. A sailing vessel having a keel structure as claimed in claim 1.

11. The keel structure of claim 1 wherein said non-movable section of said fixed main keel comprises a single member.

12. The keel structure of claim 1 wherein said non-movable section of said fixed main keel is imperforate.

13. A keel structure for a sailing vessel, said keel structure comprising a fixed main keel including a non-movable section having a foot and a bridge extending forwardly from said foot, said bridge having a forward end, and a forward foil adapted to be mounted between the underside of the vessel and said forward end of said bridge, said main keel and said forward foil when in use of said keel structure having a high pressure side and a low pressure side, said forward foil being disposed forwardly of and in tandem with said main keel to define with said main keel slot means which during use of said keel structure causes water to be accelerated through said slot means from the high pressure side of said forward foil to the low pressure side of said main keel to increase the lift acting on said main keel, said forward foil being smaller than said non-movable section of said main keel, and means for mounting said forward foil between the underside of the vessel and said bridge for movement of said forward foil in its entirety about an axis generally perpendicular to the underside of the vessel.

14. The keel structure of claim 13 wherein said forward foil is sufficiently powerful to act as a forward rudder, obviating any need for the vessel to have a separate stern rudder.

15. A keel structure for a sailing vessel, said keel structure comprising a fixed main keel including a non-movable section having a foot and a bridge extending forwardly from said foot, said bridge having a forward end, and a forward foil adapted to be mounted between the underside of the vessel and said forward end of said bridge, said main keel and said forward foil when in use of said keel structure having a high pressure side and a low pressure side, said forward foil being disposed forwardly of and in tandem with said main keel to define with said main keel slot means which during use of said keel structure causes water to be accelerated through said slot means from the high pressure side of said forward foil to the low pressure side of said main keel to increase the lift acting on said main keel, said forward foil being smaller than said non-movable section of said main keel, said main keel having a rear section that is movable relative to said non-movable section by means of an articulation joint between said rear section and said non-movable section, said forward foil being movable in its entirety by means of an articulation joint between said forward foil and said bridge and the underside of the vessel.

16. The keel structure of claim 15 in which said forward foil and said rear section of said main keel are sufficiently powerful to be used to steer the vessel, thus obviating any need for the vessel to have a separate stern rudder.

17. A keel structure for a sailing vessel, said keel structure comprising a fixed main keel including a non-movable section having a foot and a bridge extending forwardly from said foot, said bridge having a forward end, and a forward foil adapted to be mounted between the underside of the vessel and said forward end of said bridge, said main keel and said forward foil when in use of said keel structure having a high pressure side and a low pressure side, said forward foil being disposed forwardly of and in tandem with said main keel to provide a relatively close coupling of said forward foil to said main keel to define with said main keel slot means which during use of said keel structure causes water to be accelerated through said slot means from the high pressure side of said forward foil to the low pressure side of said main keel to increase the lift acting on said main keel and provide a reduction in the overall drag, said forward foil being smaller than said non-movable section of said main keel.

18. The keel structure of claim 17 wherein said forward foil has a leading edge that is swept rearward, and said main keel has a leading edge which is closest to said forward foil that is swept forward, said non-movable section of said fixed main keel comprising a single member.

* * * * *